United States Patent [19]

Shelton et al.

[11] 3,988,901

[45] Nov. 2, 1976

[54] DUAL LOOP HEAT PUMP SYSTEM

[75] Inventors: Samuel V. Shelton, Stone Mountain; Glen P. Robinson, Jr., Atlanta, both of Ga.

[73] Assignee: Scientific-Atlanta, Inc., Atlanta, Ga.

[22] Filed: Feb. 18, 1975

[21] Appl. No.: 550,413

[52] U.S. Cl. ..... 62/116; 62/501
[51] Int. Cl.[2] ..... F25B 1/00
[58] Field of Search ..... 62/2, 116, 501, 498

[56] References Cited

UNITED STATES PATENTS

| | | | |
|---|---|---|---|
| 2,209,090 | 7/1940 | Pierdti et al. | 62/501 |
| 2,986,907 | 6/1961 | Hoop | 62/116 |
| 3,699,779 | 10/1972 | Schlichtig | 62/501 |
| 3,708,996 | 1/1973 | Wurm | 62/116 |
| 3,763,663 | 10/1973 | Schlichtig | 62/116 |
| 3,861,166 | 1/1975 | Goldsberry | 62/116 |

*Primary Examiner*—Lloyd L. King
*Attorney, Agent, or Firm*—B. J. Powell

[57] ABSTRACT

A dual loop, heat driven, heat pump system including an expansion-compression device with a linearly movable operating mass such as a free piston assembly; a Rankine cycle power loop with a working fluid operatively connected to the expansion-compression device to drive same; a vapor compression heat pump loop with a working fluid operatively connected to the expansion-compression device to be driven thereby; and control means for selectively associating the working fluid of the power loop with the linearly movable mass of the expansion-compression device to cause the power loop working fluid to drive the movable mass linearly and induce linear kinetic energy in the movable mass, and for selectively associating the working fluid of the heat pump loop with the mass while the linear kinetic energy is stored therein to cause at least a portion of the kinetic energy of the mass to be transferred to the heat pump loop working fluid as compression work. The disclosure also comprehends the method of operation of the system.

18 Claims, 6 Drawing Figures

DUAL LOOP HEAT PUMP SYSTEM

BACKGROUND OF THE INVENTION

Dual loop heat pump or refrigeration systems which utilize a linear motion free-piston expansion-compression device are known in the art. An example of such system is disclosed in U.S. Pat. No. 2,637,981 which also utilizes a single working fluid in each of the loops of the system. Such systems have a power loop which operates on a Rankine cycle and a refrigeration or heat pump loop which operates on a vapor compression cycle. One of the disadvantages with these prior art systems is that the operational efficiency thereof is poor because the linear momentum and temporary storage of kinetic energy in the free-piston assembly is not utilized to compress the working fluid in the refrigeration or heat pump loop, but rather is mechanically absorbed in the compression device. This has resulted in such prior art systems being unfeasible economically and in some cases creating a system that was virtually impossible to reduce to practice. These systems have also required a relatively high operating temperature and pressure for the power loop working fluid thereby limiting the operating range of such systems. Also, a highly irreversible energy wasting throttling process must be used in these prior art systems.

SUMMARY OF THE INVENTION

These and other problems and disadvantages associated with the prior art are overcome by the invention disclosed herein by utilizing the kinetic energy and linear momentum temporarily stored in a linearly moving operating mass such as a free piston in the expansion-compression device to compress the working fluid in the heat pump loop of a dual loop heat driven heat pump system. This serves to significantly increase the operational efficiency of the system to a point where the system is economically feasible. Also the operating temperature and pressure of the working fluid of the power loop of the system can be relatively low while still efficiently operating the system and the expansion of the power loop working fluid can be accomplished without an irreversible throttling process. Further, the invention is simple in construction with only one moving part in the compression device and requires very little maintenance.

The apparatus of the system comprises an expansion-compression device operated through a linearly movable mass which is connected to a power loop operating according to the Rankine cycle and to a refrigeration or heat pump loop operating on a vapor compression cycle through a control system. The control system selectively associates the working fluid of the power loop with the linearly movable mass in the expansion-compression device to cause the power loop working fluid to drive the movable mass linearly and induce linear momentum and kinetic energy in the mass and also selectively associates the working fluid of the refrigeration or heat pump loop with the moving mass to cause at least a portion of the linear momentum and kinetic energy temporarily stored in the moving mass of the expansion-compression device to be transferred to the working fluid in the refrigeration or heat pump loop as work of compression. The power loop includes a boiler which receives heat from a heat source such as a combustion process or solar energy collector and the refrigeration or heat pump loop includes an evaporator which receives the refrigeration or heat pump loop working fluid and transfers heat from a medium to the heat pump loop working fluid. The power loop and the refrigeration or heat pump loop may share a condenser which receives both the power loop working fluid and the refrigeration or heat pump loop working fluid therein to reject heat from the working fluid to an outside medium.

The method of the invention is directed to the operation of a dual loop heat pump system with an expansion-compression device with a linearly movable operating mass, a Rankine cycle power loop driving the expansion-compression device, and a vapor compression heat pump loop driven by the expansion-compression device which includes the steps of selectively associating the working fluid of the power loop with the linearly movable mass of the expansion-compression device to cause the power loop working fluid to drive the movable mass linearly and induce linear kinetic energy in the movable mass; and, selectively associating the working fluid of the system with the mass while the linear kinetic energy is stored therein, to cause the kinetic energy of the mass to be transferred into the working fluid of the system as compression work.

These and other features and advantages of the invention will become more apparent upon consideration of the following specification and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
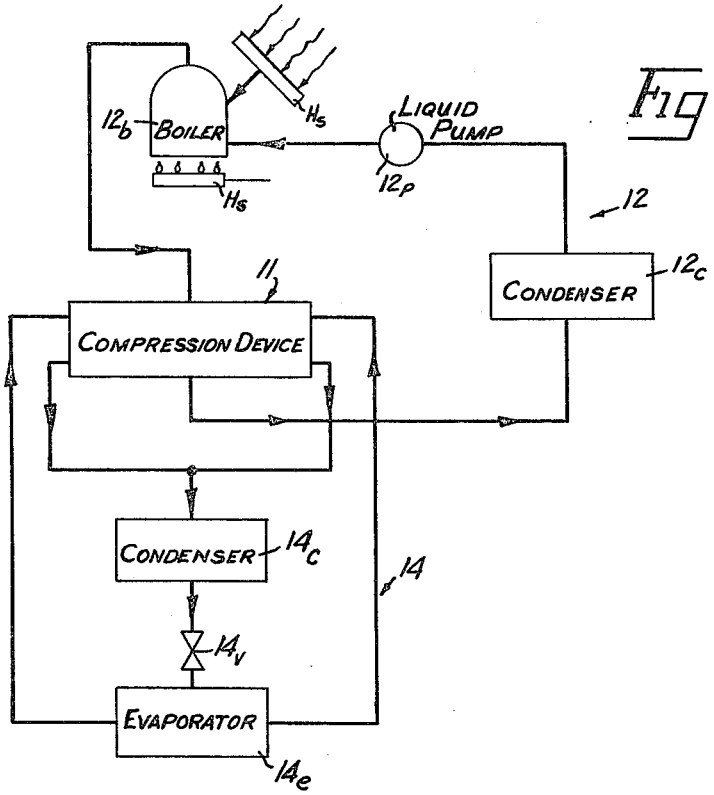
FIG. 1 is a schematic diagram illustrating a general system of the type to which the invention relates.
Figure 2:
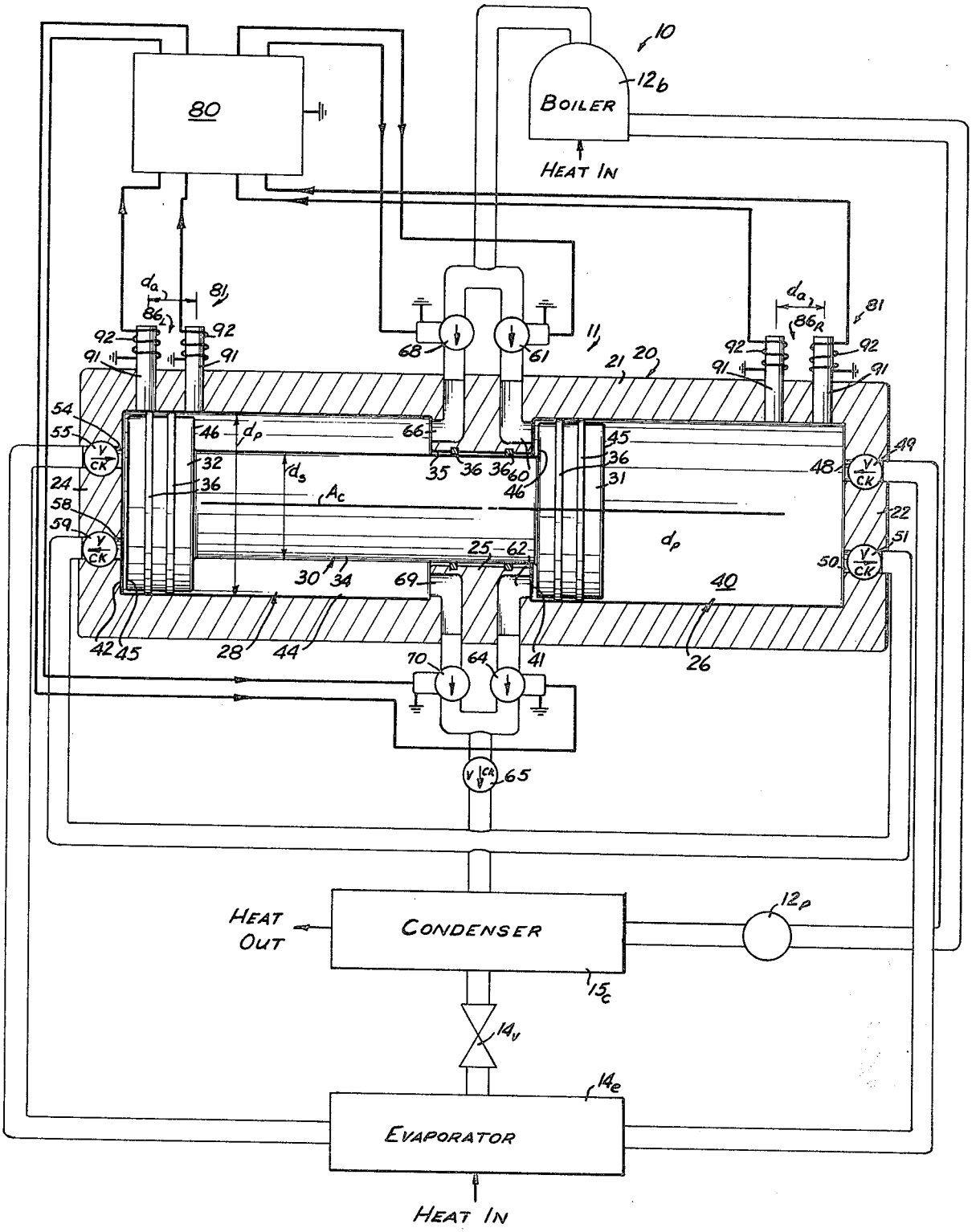
FIG. 2 is a longitudinal cross-sectional view of the expansion-compression device of the invention shown schematically connected in the system.

As seen in FIG. 1, the heat pump system 10 includes an expansion-compression device 11, hereafter referred to as a compression device, operatively connected to a power loop 12 to drive the compression device 11 and a refrigeration or heat pump loop 14 operatively connected to the compression device 11 to be driven thereby. The power loop 12 includes a boiler $\mathbf{12}_b$, a condenser $\mathbf{12}_c$ and a liquid pump $\mathbf{12}_p$. The refrigeration or heat pump loop 14 includes a condenser $\mathbf{14}_c$, an expansion valve $\mathbf{14}_v$ and an evaporator $\mathbf{14}_e$. For sake of simplicity, the refrigeration or heat pump loop will be referred to hereinafter as a heat pump loop, it being understood that this terminology also includes the refrigeration loop since the only difference between a refrigeration loop and a heat pump loop is that the medium on which the temperature is desired to be controlled is cooled by the evaporator with a refrigeration loop and heated by the condenser with a heat pump loop. While the system may have a separate power loop 12 and heat pump loop 14 shown in FIG. 1, the loops may be combined as illustrated in FIG. 2 so that the power loop 12 and the heat pump loop 14 share a condenser which has been designated $15_c$ in FIG. 2. The boiler $12_b$ has a heat source $H_s$ such as a combustion process or a solar energy collector associated therewith in a heat exchange relationship to supply the necessary energy input to drive the system.

The compression device 11 is that type which is driven by a high pressure working fluid and compresses a working fluid. The device 11 is operated by a linearly movable mass which can be reciprocated along a linear path. Different configurations may be used with one configuration illustrated in FIG. 2.

Referring now more particularly to FIG. 2, it will be seen that the compression device 11 is a free piston device which includes a cylinder 20 with an annular cylindrical side wall 21 closed at one end by end wall 22 and at its opposite end by end wall 24. A centrally located partition wall 25 separates the inside of the cylinder 20 into a first chamber 26 bounded by the side wall 21, the end wall 22 and the partition wall 25 and a second chamber 28 bounded by the side wall 21, the other end wall 24 and the partition wall 25. It will be seen that each of the chambers 26 and 28 are cylindrical and have substantially the same volume.

The compression device 11 further includes a free piston assembly 30 which is reciprocally mounted in the cylinder 20 for linear motion back and forth along the central axis $A_c$ of the cylinder 20. The free piston assembly 30 includes a pair of cylindrical pistons 31 and 32 rigidly joined together by a piston rod 34. The piston 31 is located in the chamber 26 and the piston 32 is located in the chamber 28 with the piston rod 34 slidably passing through a central hole 35 through the intermediate partition wall 25. Appropriate sealing rings 36 are provided around the pistons 31 and 32 to seal the edge of the pistons to the side wall 21 and to seal the piston rod 34 with respect to the partition wall 25. Thus, it will be seen that the piston 31 divides the chamber 26 into an outboard compression subchamber 4 and an inboard driving subchamber 41. Likewise, the piston 32 divides the chamber 28 into an outboard compression subchamber 42 and an inboard driving subchamber 44. It will be seen that the free piston assembly is the only moving component in the compression device so that wear and friction losses are reduced to an absolute minimum. It will further be noted that the free piston assembly also has a predetermined mass or weight as will become more apparent.

Each of the pistons 31 and 32 has an effective diameter $d_p$ while the piston rod 34 has a diameter $d_s$. Each of the pistons 31 and 32 has a circular outboard compression face 45, and an annular inboard driving face 46 about the piston rod 34. The faces 45 and 46 are all normal to the axis $A_c$.

An inlet port 48 is provided through the end wall 22 to the compression subchamber 40 and is connected to the outlet of the evaporator $14_e$ through an inlet check valve 49 to allow fluid to flow into subchamber 40. An outlet port 50 from compression subchamber 40 is also provided through end wall 22 and is connected to the inlet of the condenser $15_c$ through an outlet check valve 51 to allow fluid to flow from subchamber 40 to condenser $15_c$. Thus, it will be seen that the working fluid may flow into the compression subchamber 40 from the evaporator $14_e$ and flow out of the compression subchamber 40 to the inlet of the condenser $15_c$. A similar inlet port 54 to compression subchamber 42 is provided through the end wall 24 and is connected to the outlet side of the evaporator $14_e$ through an inlet check valve 55 to allow fluid to flow into subchamber 42. Also, an outlet port 58 from compression subchamber 42 is provided through the end wall 24 and is connected to the inlet side of the condenser $15_c$ through outlet check valve 59 to allow fluid to flow from subchamber 42 to condenser $15_c$. Thus, it will be seen that the working fluid can flow from the evaporator $14_e$ into the compression subchamber 42 through inlet check valve 55 and can flow out of compression subchamber 42 through the outlet check valve 59 to the condenser $15_c$.

An inlet port 60 in partition wall 25 to the driving subchamber 41 is connected to the high pressure side of the boiler $12_b$ through an inlet control valve 61 as will be more fully described. An exhaust port 62 in partition wall 25 to driving subchamber 41 is connected to the inlet side of the condenser $15_c$ through an exhaust control valve 64 and an exhaust check valve 65 in series with valve 64. Similarly, an inlet port 66 in partition wall 25 to the driving subchamber 44 is connected to the high pressure outlet of the boiler $12_b$ through an inlet valve 68. An exhaust port 69 in partition wall 25 to the driving subchamber 44 is connected to the inlet side of the condenser $15_c$ through an exhaust valve 70 in series with exhaust check valve 65. Thus, it will be seen that the free piston assembly 30 will be driven to the right as seen in FIG. 2 by opening the inlet valve 61 to introduce the boiler working fluid into the driving subchamber 41 with the exhaust valve 64 closed. It will also be noted that the heat pump loop fluid in the compression subchamber 40 will be compressed and forced out of the subchamber 40 into the inlet side of the condenser $15_c$ through the outlet check valve 51 when the fluid pressure in subchamber 40 exceeds the condenser fluid pressure. It will also be noted that, during the rightward movement of the free piston assembly 30, the inlet valve 68 will be closed and the exhaust valve 70 will be opened so that the driving fluid from the boiler that has been previously introduced into the driving chamber 44 can exhaust through the exhaust valve 70 and the check valve 65 into the condenser $15_c$. In order to drive the free piston assembly 30 to the left, the inlet valve 61 is closed and the exhaust valve 64 is opened while the inlet valve 68 is opened and the exhaust valve 70 is closed to introduce the boiler working fluid into the driving subchamber 44. It will be seen that this causes the heat pump loop fluid in the compression subchamber 42 to be forced out of the compression subchamber 42 through the outlet check valve 59 and into the inlet of the condenser $15_c$ when the fluid pressure in subchamber 42 exceeds the condenser fluid pressure.

A control system 80 is provided to control the operation of the inlet valves 61 and 68 and the exhaust valves 64 and 70 and thus the operation of the system. The system 80 senses the linear momentum and kinetic energy in the mass of piston assembly 30 and controls the operation of valves 61, 64, 68 and 70 so that the kinetic energy temporarily stored in the piston assembly 30 is used to compress the working fluid in the heat pump loop 14. Thus, the kinetic energy need not be absorbed by the piston assembly 30 striking the end walls of the cylinder 20 as was the case with the prior art.

Figure 3:
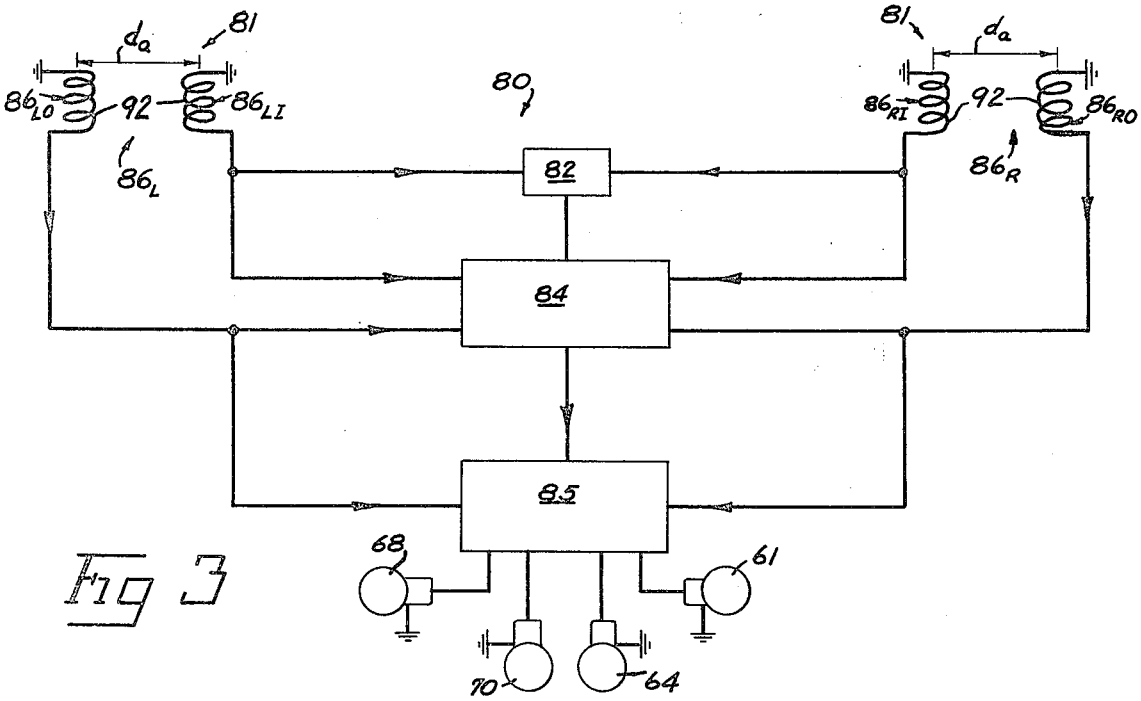
FIG. 3 is a schematic block diagram of the control system.

As seen in FIGS. 2 and 3, the control system 80 includes sensing means 81 for sensing the velocity and thus the kinetic energy of the piston assembly 30 along a predetermined portion of its travel and generating an actual output signal representative of this velocity. The control system 80 also includes a reference signal generating means 82 for generating a standard reference signal representative of what the velocity of the piston assembly 30 should be along this predetermined portion of its travel. A comparator means 84 is provided which compares the actual output signal of the sensing means 81 and the standard reference signal from the reference signal generating means 82, and produces a compared signal output representative of the difference between the actual output signal and the standard reference signal. The system 80 also includes valve drive means 85 which receives the compared signal output from the comparator means 84 and controls the opening and closing of valves 61, 64, 68 and 70 in response thereto. The control system 80 may be mechanical, hydraulic, pneumatic or electrical. For sake of simplicity, only the electrical version is illustrated in FIGS. 2 and 3.

The sensing means 81 illustrated in FIG. 2 is of the electromagnetic type. Means 81 includes two pairs of sensors $\mathbf{86}_R$ and $\mathbf{86}_L$. Sensors $\mathbf{86}_R$ are located adjacent the outboard end of chamber 26 and sensors $\mathbf{86}_L$ are located adjacent the outboard end of chamber 28. Sensors $\mathbf{86}_R$ produce an output signal representative of the velocity of piston assembly 30 near the end of its rightward movement while sensors $\mathbf{86}_L$ produce an output signal representative of the velocity of piston assembly 30 near the end of its leftward movement.

All of the sensors $\mathbf{86}_R$ and $\mathbf{86}_L$ have the same construction so only one will be described in detail. It will further be seen that each pair of sensors $\mathbf{86}_R$ and $\mathbf{86}_L$ have an outboard sensor $\mathbf{86}_{RO}$ and $\mathbf{86}_{LO}$ respectively located adjacent the outboard ends of chambers 26 and 28 respectively and an inboard sensor $\mathbf{86}_{RI}$ and $\mathbf{86}_{LI}$ respectively located inboard of sensors $\mathbf{86}_{RO}$ and $\mathbf{86}_{LO}$ a predetermined distance $d_a$ as seen in FIGS. 2 and 3.

The construction of sensor $\mathbf{86}_{RO}$ will be described in detail with like reference numbers applied to the other sensors in FIG. 2. The piston assembly 30 is made of a ferromagnetic material and the side wall 21 of cylinder 20 is made of a non-magnetic material such as aluminum. Sensor $\mathbf{86}_{RO}$ includes a permanent magnet core 91 which extends through the cylinder wall 21 and a wire coil 92 is wrapped around core 91 so that an electrical pulse will be operated by the disturbance of the magnetic field surrounding coil 92 when the piston 31 of assembly 30 moves into and out of registration with core 91. If the cylinder wall 21 is made of a ferromagnetic material, then a sleeve of non-magnetic material may be placed around core 91 in wall 21 to magnetically insulate core 91 from wall 21.

Figure 4:
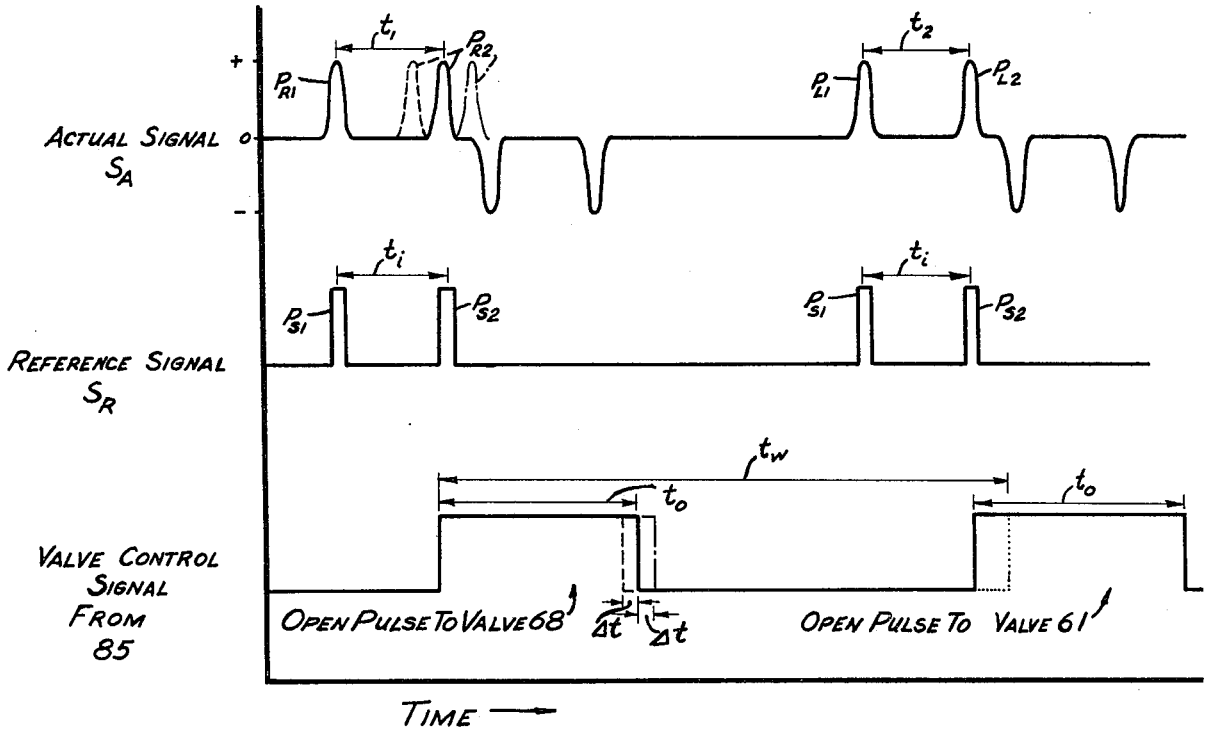
FIG. 4 is a schematic diagram illustrating the relationship of the various operating signals of the control system.

From the foregoing, it will be seen that the magnetic field at the sensors will be stronger when the piston assembly 30 covers the core 91 of each of the sensors than when the core 91 is not covered by the piston assembly 30. Therefore, as the piston assembly 30 travels from the left to the right, the sensors $\mathbf{86}_R$ will each produce an electrical pulse as the piston 31 of the assembly 30 nears the right hand end of its stroke, and as the piston assembly 30 travels from the right to the left as seen in FIG. 2, the left sensors $\mathbf{86}_L$ will each produce an electrical pulse as the piston 32 of assembly 30 nears the end of its leftward stroke. The time interval $t_1$ as seen in FIG. 4 between the pulse $P_{R1}$ of the sensor $\mathbf{86}_{RI}$ and the pulse $P_{R2}$ of the sensor $\mathbf{86}_{RO}$ or the time interval $t_2$ between the pulses $P_{L1}$ of the sensor $\mathbf{86}_{LI}$ and the pulse $P_{L2}$ of the sensor $\mathbf{86}_{LO}$ is a measure of the average velocity of the piston assembly 30 as it moves the distance $d_a$ between the sensors. This average velocity should be some predetermined small value in order to insure that the piston assembly 30 reaches the end of its stroke in both directions but does so with a small or zero velocity at the end of its stroke. This desired average velocity corresponds to some standard reference time between sensor pulses which is designated $t_i$ in FIG. 4 for the reference signal $S_R$.

It will be seen that the output of the sensors $\mathbf{86}_R$ and $\mathbf{86}_L$ are connected to the comparator means 84. The outputs of the inboard sensors $\mathbf{86}_{RI}$ and $\mathbf{86}_{LI}$ are also connected to the reference signal generating means 82. The outputs of the outboard sensors $\mathbf{86}_{RO}$ and $\mathbf{86}_{LO}$ are also connected to the valve drive means 85 and the output of the comparator means 84 is connected to the valve drive means 85. The outputs of the valve drive means 85 are connected individually to the inlet valves 61 and 68 and individually to the exhaust valves 64 and 70. While different types of valves 61, 64, 68 and 70 may be used, those illustrated are solenoid operated. The reference signal generating means 82 produces a standard reference signal $S_R$ as seen in FIG. 4 which has a first pulse $P_{S1}$ that coincides with the pulse generated by the inboard sensors $\mathbf{86}_{RI}$ and $\mathbf{86}_{LI}$ since the pulse of these inboard sensors trigger the reference signal generating means 82. The reference signal generating means 82 then produces a second reference pulse $P_{S2}$ which has the time interval $t_i$ between the pulses $P_{S1}$ and $P_{S2}$ that corresponds to a time interval which the desired average velocity of the piston assembly 30 should have as it passes between the sensors $\mathbf{86}_R$ and $\mathbf{86}_L$. The output of the reference signal generating means 82 is fed to the comparator means 84 where the reference signal $S_R$ is compared to the actual signal $S_A$ from the sensors $\mathbf{86}_R$ or $\mathbf{86}_L$. The comparator means 84 determines the difference between the reference signal $S_R$ and the actual signal $S_A$ and produces an output which indicates the relationship between the time interval $t_1$ or $t_2$ between the pulses of the actual signal $S_A$ and the time interval $t_i$ between the reference pulses $P_{S1}$ and $P_{S2}$ of the reference signal $S_R$. If time interval $t_1$ or $t_2$ is greater than time interval $t_i$, a first output signal is generated by the comparator means 84; if the time interval $t_1$ or $t_2$ is equal to the time interval $t_i$, a second signal is generated by the comparator means 84; and, if the time interval $t_1$ or $t_2$ is less than the time interval $t_i$, a third signal is generated by the comparator means 84. These output signals of the comparator means are fed to the valve drive means 85 to act as a control for the valve drive means as will become more apparent.

The valve drive means 85 is constructed and arranged so that when it receives a pulse $P_{R2}$ from the sensor $\mathbf{86}_{RO}$, it opens the inlet valve 68 and the exhaust valve 64 while maintaining the inlet valve 61 and the exhaust valve 70 closed. The valve drive means 85 holds the inlet valve 68 open for a prescribed time interval $t_o$ and then closes the inlet valve 68 while leaving the exhaust valve 64 open and maintaining the inlet valve 61 and the exhaust valve 70 closed. When the valve drive means 85 receives a pulse $P_{L2}$ from the outboard sensor $\mathbf{86}_{LO}$, it opens the inlet valve 61 while maintaining the inlet valve 68 closed, closes the exhaust valve 64 and opens the exhaust valve 70. The valve drive means 85 then maintains the inlet valve 61 open for the prescribed time interval $t_o$ whereupon it closes the valve 61 while maintaining the exhaust valve 70 open and maintaining the inlet valve 68 and exhaust valve 64 closed. The valve drive means 85 is also responsive to the output signal of the comparator means 84 to adjust the time interval $t_o$ during which the valves 61 or 68 are maintained open. For instance, if the time interval $t_1$ or $t_2$ in the signal $S_A$ is greater than the time interval $t_i$ of the reference signal $S_R$ that indicates the piston assembly 30 is traveling too slow, then the valve drive means 85 increases the time interval $t_o$ by a prescribed time increment $\Delta t$, shown by a phantom line in the valve opening pulse to valve 68 in FIG. 4, that the valves 61 or 68 are maintained open during each succeeding stroke. If the time interval $t_1$ or $t_2$ of the actual signal $S_A$ is equal to the time interval $t_i$ of the reference signal $S_R$ that indicates that the piston assembly 30 is traveling at the desired velocity, the signal output of the comparator means 84 causes the valve drive means 85 to maintain the time interval $t_o$ the same during each succeeding stroke. If the time interval $t_1$ or $t_2$ of the actual signal $S_A$ is less than the time interval $t_i$ of the reference signal $S_R$ that indicates that the piston assembly 30 is traveling too fast, the output of the comparator means 84 causes the valve drive means 85 to reduce the time interval $t_o$ by the prescribed time increment $t$ during each succeeding stroke, as shown by a dashed line in the valve opening pulse to valve 68 in FIG. 4. If the valve drive means 85 has not received a signal from the comparator means 84 after a prescribed time interval $t_w$ following the opening of valve 61 or 68, the valve drive means 85 will automatically add the prescribed time increment $\Delta t$ to the time interval $t_o$ and transfer the appropriate valves 61, 64, 68 and 70 to reverse the motion of assembly 30. The time interval $t_w$ is selected to be at least as great as the maximum time interval which is required by the piston assembly 30 to reach the maximum extent of its stroke after valve 61 or 68 is opened as will become more apparent.

OPERATION

The operation of the heat pump system 10 will be described in detail for only the rightward movement of the free piston assembly 30 from the leftmost position seen in FIG. 2, it being understood that the leftward movement would be similar. Any number of working fluids may be used in this system such as the commercially available refrigerants sold under the trademark "Freon" by E. I. DuPont deNemours & Co. This refrigerant working fluid lends itself to use both in the power loop 12 and the heat pump loop 14. The working fluid in the boiler $\mathbf{12}_b$ will have some prescribed pressure $P_b$ and some prescribed temperature $T_b$. The condenser $\mathbf{15}_c$ will have some prescribed pressure $P_c$ and some prescribed temperature $T_c$. Likewise, the evaporator $\mathbf{14}_e$ will have some prescribed pressure $P_e$ and some prescribed temperature $T_e$.

With the free piston assembly 30 shown in its leftmost position in FIG. 2, the control system 80 opens the inlet valve 61 to the driving subchamber 41 and the exhaust valve 70 to the driving subchamber 44. The inlet valve 68 and exhaust valve 64 are closed. This causes the driving subchamber 41 to be exposed to the boiler pressure $P_b$ and the driving subchamber 44 to be exposed to the lower condenser pressure $P_c$. It will also be noted that, at this time, the compression subchambers 40 and 42 will be exposed to the evaporator pressure $P_e$. Also, in normal operation, the temperature $T_b$ of the boiler $\mathbf{12}_b$ is greater than the temperature $T_c$ of the condenser $\mathbf{15}_c$ which in turn is greater than the temperature $T_e$ of the evaporator $\mathbf{14}_e$ so that the pressure $P_b$ is greater than the pressure $P_c$ which in turn is greater than the pressure $P_e$. Because the pressure $P_b$ is greater than the other pressures, the piston assembly 30 will be accelerated to the right under the influence of the working fluid vapor from the boiler. During this acceleration, it will be noted that the pressure in the compression subchamber 44 remains substantially constant at the condenser pressure $P_c$ while the pressure in the compression subchamber 42 remains substantially constant at the evaporator pressure $P_e$. Thus, it will be seen that the working fluid vapor from the evaporator $\mathbf{14}_e$ will be drawn into the compression subchamber 42 through the inlet check valve 55 and the working fluid in the compression subchamber 44 will be forced into the condenser $\mathbf{15}_c$ through the open exhaust valve 70 and the check valve 65 as the piston assembly 30 moves to the right. Initially, the pressures in both the compression subchambers 40 and 42 are at the evaporator pressure offsetting each other on the piston assembly 30. Because the boiler pressure $P_b$ introduced into the driving subchamber 41 is greater than both the evaporator pressure $P_e$ and the condenser pressure $P_c$, the working fluid vapor from the boiler $\mathbf{12}_b$ will be providing sufficient force to cause the piston assembly 30 to accelerate to the right compressing the working fluid in the compression subchamber 40. No working fluid will flow out of the compression subchamber 40, however, until pressure in subchamber 40 reaches the condenser pressure $P_c$ whereupon the working fluid flows out through the outlet check valve 51 into the condenser $\mathbf{15}_c$.

While valve 61 is open, a certain amount of the work being done by the working fluid pressure in power loop 12 from the boiler $\mathbf{12}_b$ is being transferred directly through the piston 31 to compress the working fluid of the heat pump loop 14 in the compression subchamber 40 and directly through the piston 32 to expel the fluid in subchamber 44 into condenser $\mathbf{15}_c$. It will also be noted that the working fluid vapor from the boiler $\mathbf{12}_b$ is providing additional work which is not transferred directly to the working fluid in subchamber 40 or 42 but is absorbed in the piston assembly 30 itself as kinetic energy due to the velocity induced in the piston. This also gives the piston assembly 30 a certain linear momentum. After the time interval $t_o$ has elapsed, the control system 80 closes the inlet valve 61 while still maintaining the exhaust valve 70 open. It will be noted that the time interval $t_o$ is usually less than the time necessary for the free piston assembly 30 to travel the full stroke from the left to the right. Up to this point in the cycle, the pressure in the driving subchamber 41 will have been essentially constant at the boiler pressure $P_b$, however, when the valve 61 is closed, the pressure in the driving subchamber 41 will start to drop as the piston assembly 30 continues to move to the right and the working fluid in this driving subchamber 41 is allowed to expand. Because this pressure is initially still above the condenser pressure $P_c$, it will continue to drive the free piston assembly 30 to the right. It will also be noted that the pressure in the compression subchamber 40 has been first raised from the evaporator pressure $P_e$ to the condenser pressure $P_c$ and that, when the condenser pressure $P_c$ is reached, the pressure within the compression subchamber 40 will remain substantially constant at the condenser pressure $P_c$ since the check valve 51 is opened. Since the pressure of the working fluid in the driving subchamber 41 is dropping as the free piston assembly 30 continues to move to the right, its ability to do work is decreasing while at the same time the work which must be done on the working fluid in the compression subchamber 40 in order to continue the movement of the piston assembly 30 has risen from an initially low value when the pressure in the compression subchamber 40 is at evaporator pressure $P_e$ to that value which is necessary to move the piston assembly 30 when the pressure in the subchamber 40 is at the higher pressure substantially equal to the condenser pressure $P_c$ and causes the assembly 30 to expel the working fluid into condenser $\mathbf{15}_c$. Because the ability of the working fluid in the driving subchamber 41 to do work is decreasing after some point in the stroke of the piston assembly 30, the free piston assembly 30 starts to decelerate. This deceleration is caused by the back pressure of the working fluid in the compression subchamber 40 on the face 45 of the piston 31 and the back pressure of the working fluid in the driving subchamber 44 on the face 46 of piston 32, and allows the kinetic energy that is stored in the piston assembly 30 to be absorbed into the working fluid as work of compression in the compression subchamber 40 and driving subchamber 44. Work of compression as used herein includes both the energy used to raise the pressure in the working fluid from a lower to higher value and the energy used to flow the working fluid under a prescribed pressure.

If the time $t_o$ during which the inlet valve 61 remains open is the correct timing for the particular boiler pressure $P_b$, the piston assembly 30 will be decelerated so that it reaches a zero velocity at its rightmost position. This means that the total net work done on the piston assembly 30 during its rightward movement will be zero and that the work done on the piston assembly 30 to produce the stored kinetic energy therein will be completely transferred back out of the piston assembly 30 as work of compression to the working fluid in the compression subchamber 40 and driving subchamber 44. The time interval $t_i$ of the reference signal $S_R$ is selected so that the piston assembly 30 will reach zero velocity at its rightmost position. Thus, if time interval $t_o$ is the proper interval for the pressures involved, the time interval $t_1$ in the actual signal $S_A$ will be equal to the time interval $t_i$ in the reference signal $S_R$ and the output of the comparator means 84 will cause the time interval $t_o$ to remain the same on the next stroke of the piston assembly 30. Such a signal $S_A$ is shown in solid lines for pulse $P_{R2}$ in FIG. 4. If, however, the initial time interval $t_o$ during which the inlet valve 61 is held open is greater than that necessary to completely decelerate the piston assembly 30, the piston assembly 30 will strike the right hand end wall 22 of the cylinder and dissipate the excess kinetic energy in that collision. If such is the case, the time interval $t_1$ between the pulses in the actual signal $S_A$ will be less than the time interval $t_i$ of the reference signal $S_R$. Such a signal $S_A$ is shown by the dashed line pulse $P_{R2}$ in FIG. 4. This will cause a corresponding signal output from the comparator means 84 to the valve drive means 85 that in turn causes the time interval $t_o$ to be decreased by the time interval increment $\Delta t$ as the free piston assembly 30 is moved to the left as seen in FIG. 2. On the other hand, if the initial time interval $t_o$ is such that the free piston assembly 30 will not be driven to its rightmost position sufficiently fast, the time interval $t_1$ in the actual signal $S_A$ will be greater than the time interval $t_i$ in the reference signal $S_R$. Such a signal $S_A$ is shown by the phantom line pulse $P_{R2}$ in FIG. 4. This will cause a corresponding signal output from the comparator means 84 to the valve drive means 85 that causes the time interval $t_o$ to be increased by the time interval increment $\Delta t$ as the free piston assembly 30 moves to the left as seen in FIG. 2. Further, if the time interval $t_o$ is not sufficient to move the free piston assembly 30 far enough to the right to generate the two pulses of signal $S_A$, the valve drive means 85 will cause the valves to shift to move the free piston assembly 30 to the left as seen in FIG. 2 while at the same time increasing the time interval $t_o$ by the time interval increment $\Delta t$ after the maximum allowable time interval $t_w$ for the piston assembly 30 to complete its stroke has elapsed. From the foregoing, it will be seen that the control system 80 causes the valves 61, 64, 68 and 70 to be operated in such manner that the piston assembly 30 is always moved toward a zero velocity at the end of its stroke in either direction thereby producing a maximum efficiency of operation.

When the free piston assembly 30 reaches the rightmost position for its left-to-right stroke, it will be seen that the outboard sensor $\mathbf{86}_{RO}$ will send a pulse to the valve drive means 85 which causes the valves 61, 64, 68 and 70 to be transferred to reverse the cycle. This is accomplished by closing exhaust valve 70, opening exhaust valve 64 and opening inlet valve 68 for the prescribed time interval $t_o$, which may have been adjusted, while maintaining the inlet valve 61 closed. Thus, this system will keep repeating these cycles while at the same time continually adjusting itself to cause the free piston assembly 30 to achieve a zero velocity at the end of each stroke. It will also be noted that at the end of each stroke, the pressure in the compression subchamber 40 or 42 which is having the heat pump loop working fluid expelled therefrom into the condenser $\mathbf{15}_c$ will momentarily be at the higher condenser pressure. Because the volume of the subchamber 40 or 42 at this point in the cycle is extremely small, the piston assembly 30 will shift slightly in the opposite direction by a very small amount to allow the pressure in that compression subchamber 40 or 42 to drop back to the evaporator pressure $P_e$. Thus, for all practical purposes, the pressure in the particular compression subchamber 40 or 42 in which the fluid is being compressed will be at evaporator pressure $P_e$ at the end of the stroke. It will also be noted that this system is able to compensate for changes in boiler pressure, condenser pressure and evaporator pressure, especially if these pressures change relatively slowly as compared to the cycle rate of the free piston assembly 30 as is usually the case.

To better appreciate the overall operation of the system, a specific example will be described in detail which is operating under design conditions. Under these conditions, the working fluids in both the power loop 12 and the heat pump loop 14 is Refrigerant-12 ("Freon-12," a trademark of E. I. DuPont deNemours & Co.). The condenser temperature $T_c$ will be assumed at 90° F which is typical for a water cooled condenser and the evaporator temperature $T_e$ will be assumed to be 40° F. A boiler temperature $T_b$ of 150° F will be assumed which might be typical for a solar driven boiler. The condenser and evaporator outlet conditions will be assumed saturated liquid and saturated vapor respectively and the boiler outlet condition will also be assumed as saturated vapor. The diameter $d_p$ of the pistons 31 and 32 will be selected at 3 inches with a rod diameter $d_s$ selected at 2.17 inches and the maximum length of the stroke of the piston assembly 30 will be selected at 12 inches. At the temperatures given, data for Refrigerant-12 shows that the pressure $P_e$ of the evaporator $\mathbf{14}_e$ will be 51.7 psia, the boiler pressure $P_b$ will be 249.3 psia and the condenser pressure $P_c$ will be 114.5 psia. The weight of the piston assembly 30 will be assumed at 25 pounds although the piston assembly 30 may be any convenient weight without materially affecting the overall performance of the system.

Table I illustrates the various pressures and net work energy in the free piston assembly 30 encountered during the movement from the free piston assembly 30 from the left to the right in FIG. 2 when the inlet valve opening time is correct. The particular time interval $t_o$ used in this example is 36 milliseconds. It will be seen that like data would be obtained during the movement of the free piston assembly 30 from the right to the left except that the pressures in the driving subchambers 41 and 44 would be reversed and the pressures in the compression subchambers 40 and 42 would be reversed. It will also be noted that under the given conditions for the boiler pressure $P_b$, the condenser pressure $P_c$ and the evaporator pressure $P_e$, the particular dimensions selected in this example will cause the pressure in the particular driving subchamber 41 or 42 to be substantially equal to the condenser pressure $P_c$ at the end of the stroke of the free piston assembly 30. In this example, the inlet valve 61 would be closed after the free piston assembly 30 had moved for 45% of its stroke or 5.4 inches. It is to be understood, however, that the percentage of the piston assembly stroke that the inlet valves are maintained open is dependent on the pressure involved as well as the dimensions of the free piston assembly 30. Under any particular set of pressures $P_b$, $P_c$ and $P_e$ and set of dimensions for the free piston assembly, the inlet valve would be maintained open for the same percentage of the stroke of piston assembly 30 even though the weight of the free piston assembly is changed. On the other hand, the time interval $t_o$ that the inlet valves would remain open would change because a lighter piston assembly 30 would move faster and complete its stroke sooner while a heavier piston assembly 30 would move slower and complete its stroke later. Thus, it will be seen that the weight of the piston assembly 30 can be used to control the stroke frequency of the compression device.

Figure 5:
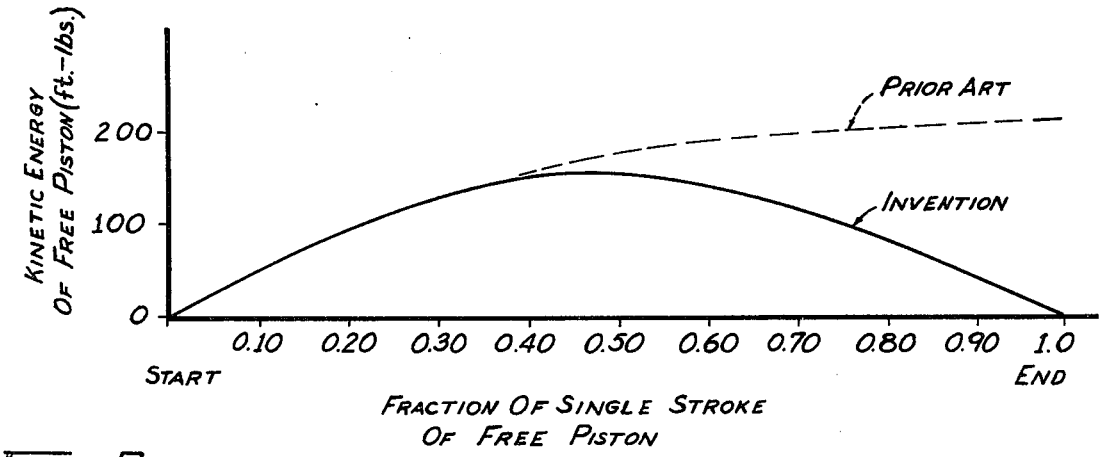
FIG. 5 is a graph illustrating the difference between the net work on the free piston assembly of the invention and the prior art; and, FIG. 6 is a partial view similar to FIG. 2 showing a low heat loss version of the expansion-compression device.

One advantage of this system over the prior art system which leaves the inlet valve open for the entire stroke of the free piston assembly is best illustrated in FIG. 5. The solid line curve illustrates the kinetic energy of the free piston assembly of this invention at any particular position in its stroke. It will be seen that, initially, the temporarily stored kinetic energy in the piston assembly of this invention is increasing. At some point in the stroke of the free piston assembly 30, the temporarily stored kinetic energy in the free piston assembly reaches a maximum amount whereupon the piston assembly 30 starts decelerating while the stored kinetic energy in the piston assembly starts decreasing. Where the inlet valve open time is such that the free piston assembly decelerates to a zero velocity by the end of its stroke, as is the case with this invention, the stored kinetic energy in the piston assembly is also zero and the kinetic energy induced in the piston assembly by the power loop working fluid has been transferred to the working fluid in the compression device as work of compression. That point in the stroke of the free piston assembly where the stored kinetic energy reaches a maximum amount is that point where the working fluid pressure forces on the free piston assembly balance. This point is dependent on pressure and may occur before, after, or at the same time the inlet valve is closed.

The dashed line curve in FIG. 5 shows the stored kinetic energy in the free piston assembly at any particular position in its stroke when the inlet valve is left open for the complete stroke of the piston assembly as is associated with the prior art. It will thus be seen that the stored kinetic energy in the free piston assembly of the prior art continues to rise during the complete stroke and has a significant amount of kinetic energy stored therein at the end of the stroke. The kinetic energy in the piston assembly at the end of the stroke must be dissipated by striking the ends of the housing or by some other means. In the sample illustrated, approximately 200 ft.-lbs. of work would be lost by failure to re-absorb the kinetic energy imposed in the free piston assembly into the working fluid of the heat pump loop as work of compression. This significantly decreases the efficiency of the prior art system over the system of the invention.

In prior art systems which leave the inlet valve open for the complete stroke of the free piston assembly, the pressure forces on the free piston assembly are required to balance at the end of the stroke. These prior art systems thus required a minimum boiler pressure equal to or greater than two times the condenser pressure minus the evaporator pressure when the rod diameter is disregarded. On the other hand, the minimum boiler pressure required to operate the system of this invention is significantly less than the prior art as is set forth by the following equation which also neglects the cross-sectional area of the piston rod:

$$P_b = P_c + \int_0^1 P_{40}\, dx - P_e$$

where $P_{40}$ is the pressure in the compression subchamber 40 and $x$ is the fraction of the stroke of the piston assembly 30. If the pressure $P_{40}$ were equal to the condenser pressure $P_c$ during the entire stroke, the required minimum boiler presssure $P_b$ in the two systems would be the same, however, the pressure $P_{40}$ is less than the condenser pressure $P_c$ during a significant portion of the stroke of the free piston assembly 30 and therefore the required minimum boiler pressure $P_b$ for the invention is less than the prior art. It will be noted that this minimum boiler pressure $P_b$ for the invention will be greater than the condenser pressure $P_c$ less than the evaporator pressure $P_e$.

Because the prior art systems leaves the inlet valve open during the entire stroke of the free piston assembly, the pressure in the driving subchamber at the end of the stroke of the free piston assembly is substantially equal to the boiler pressure and therefore considerably higher than the condenser pressure. Thus, when the exhaust valve to that particular driving subchamber of the prior art is opened to reverse the motion of the free piston assembly, this higher pressure throttles down to the condenser pressure resulting in a waste of energy. It will be noted that in the system of this invention, however, there is always less throttling loss than that associated with the prior art, and if the system of this invention is operating on design, there will be substantially no throttling loss. Also, because the inlet valve to the driving subchamber of the prior art systems remains open for the entire stroke of the free piston assembly, these prior art systems require more mass of the working fluid from the boiler per stroke of the free piston assembly yet the amount of working fluid in the heat pump loop pulled into the compression subchamber, compressed and expelled to the condenser remains the same as the system of this invention. This also serves to lower the operating efficiency of those prior art systems with respect to this invention. As a result, the coefficient of performance of prior art heat pump systems which fail to utilize the stored kinetic energy in the free piston assembly is always less than the coefficient of performance of the system disclosed herein. If the system disclosed herein is operating at its design conditions, the coefficient of performance of the prior art systems is less than half of the coefficient of performance of the system disclosed herein. The calculated coefficient of performance of the system disclosed herein operating at design conditions is 0.81.

One of the major advantages of the system disclosed herein is that it has the capability of operating over a wide temperature range for the boiler $12_b$. This becomes especially critical if one is attempting to drive the boiler $12_b$ through a solar collector inasmuch as the solar energy radiation received at any location varies considerably over a twenty-four hour period. Even if the boiler temperature $T_b$ drops below the design conditions, the control system 80 will keep the inlet valves 61 and 68 open for a longer period of time in order to provide enough work to move the free piston assembly 30 through its entire stroke. The control system 80 will continue to cause the free piston assembly 30 to move through its entire stroke until a minimum boiler pressure is reached which causes the inlet valves 61 or 68 to remain open for the entire duration of the stroke of the free piston assembly 30. This pressure is greater than the condenser pressure but less than two times the condenser pressure minus the evaporator pressure. When the boiler pressure drops below the design conditions, the pressure in the driving subchamber 41 or 42 at the end of the stroke will be above the condenser pressure and will create some throttling loss as the exhaust valve 64 or 70 is opened, however, this throttling loss will always be less than the throttling loss associated with the prior art systems. On the other hand, when the boiler temperature $T_b$ and thus the boiler pressure $P_b$ increases, the control system 80 will hold the inlet valves 61 and 68 open for a shorter period of time during the stroke of the free piston assembly 30 which serves to increase the coefficient of the performance of the system. The pressure in the driving subchambers 41 or 44 at the end of the stroke of the free piston assembly 30 under higher boiler pressure conditions will be less than the condenser pressure, however, the check valve 65 connecting the driving subchambers 41 and 44 to the condenser $15_c$ prevents the condenser pressure from entering the driving subchambers 41 and 44 and will serve to hold the working fluid within the driving subchambers 41 or 44 until the free piston assembly 30 has moved in the opposite direction sufficiently to raise the pressure in the driving subchambers 41 or 44 up to the condenser pressure $P_c$.

The aforementioned calculations have assumed ideal compression and expansion in the compression device 11, however, some energy would be lost in the heat transfer that will take place between the working fluid and the compression device 11 and the pressure loss through the various valves of the system because of fluid friction. Also, some energy would be lost due to the sliding friction between the free piston assembly 30 and the cyclinder 20 as it slides therein. Because of the simplicity of this free piston compression device 11, however, these effects can be maintained relatively small.

LOW HEAT LOSS VERSION

Figure 6:
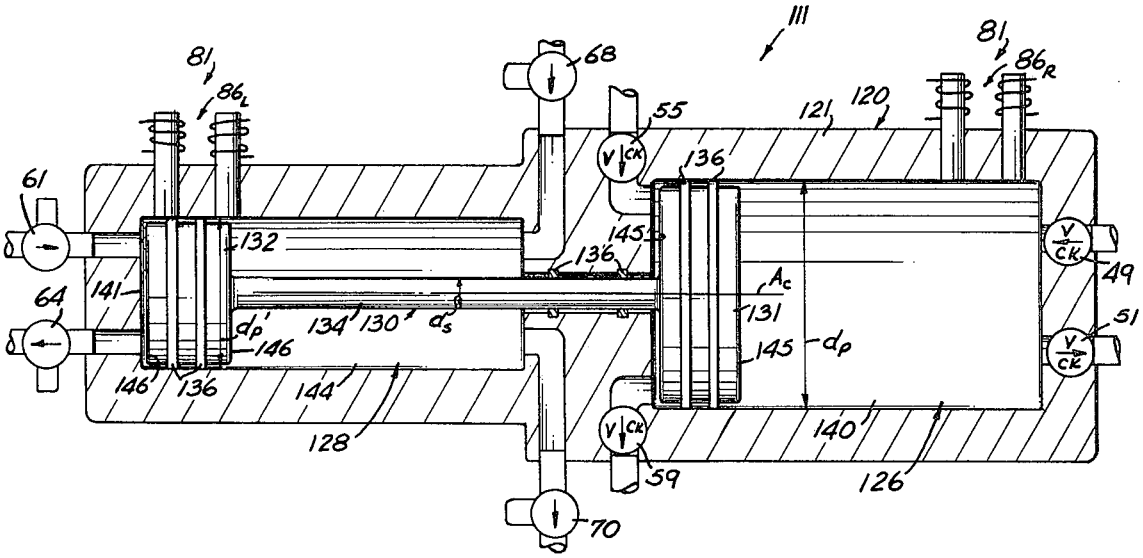

FIG. 6 illustrates a low heat loss version of the compression device and is designated by the numeral 111. The components of the compression device 111 corresponding to those of device 11 have like reference numbers applied thereto displaced by 100 and while the valves of the compression device 111 have like reference numbers applied thereto and operate in the same manner as their corresponding valves in device 11.

The difference between the device 111 and device 11 is that both of the compression subchambers 140 and 142 are located in the same chamber 126 while both of the driving subchambers 144 and 141 are located in the same chamber 128. Also, the piston rod 134 is sufficiently small to have a negligible effect on the inside faces 145 and 146 of pistons 131 and 132. The design pressure of the power loop working fluid in driving chambers 141 or 144 is kept at condenser pressure at the end of the strokes by making the effective diameter $d_p'$ of piston 132 smaller than the diameter $d_p$ of piston 131. This serves to isolate those portions of side wall 121 associated with the hotter power loop working fluid from those portions of the side wall 121 associated with the cooler heat pump loop working fluid to reduce the heat transfer between the working fluids by the side wall 121.

It is to be understood that full use of modifications, substitutions and equivalents may be made without departing from the scope of the invention as disclosed herein.

TABLE I

| | Fraction of stroke | Time (msec) | Pressure (psia) 41 | 44 | 40 | 42 | Net Linear Kinetic Energy in Piston Assembly 30 | |
|---|---|---|---|---|---|---|---|---|
| (left-most) | 0 | 0 | 249.3 | 114.5 | 51.7 | 51.7 | 0 | (ft lb) |
| | .1 | 13.4 | 249.3 | 114.5 | 59 | 51.7 | 42 | |
| | .2 | 21.3 | 249.3 | 114.5 | 66 | 51.7 | 81 | |
| | .3 | 27.8 | 249.3 | 114.5 | 76 | 51.7 | 113 | |
| | .4 | 33.2 | 249.3 | 114.5 | 88 | 51.7 | 137 | |
| | .45 | 36.0 | 249.3 | 114.5 | 97 | 51.7 | 142 | |

TABLE I-continued

| | Fraction of stroke | Time (msec) | Pressure (psia) 41 | 44 | 40 | 42 | Net Linear Kinetic Energy in Piston Assembly 30 |
|---|---|---|---|---|---|---|---|
| | .5 | 38.4 | 226.7 | 114.5 | 107 | 51.7 | 147 |
| | .53 | 39.1 | 215.0 | 114.5 | 114.5 | 51.7 | 143 |
| | .6 | 43.4 | 190.9 | 114.5 | 114.5 | 51.7 | 133 |
| | .7 | 49.5 | 163.6 | 114.5 | 114.5 | 51.7 | 111 |
| | .8 | 56.0 | 143.2 | 114.5 | 114.5 | 51.7 | 80 |
| | .9 | 63.9 | 126.5 | 114.5 | 114.5 | 51.7 | 45 |
| (right-most) | 1.0 | 77.0 | 114.5 | 114.5 | 114.5 | 51.7 | 0 |

What is claimed is:

1. A method of operating a dual loop heat pump system with an expansion-compression device with a linearly movable operating free piston assembly slidably carried in a chamber for linear movement in the chamber along a prescribed path, the free piston dividing the chamber into a first subchamber of varying size as the free piston assembly moves along the prescribed path and a second subchamber of varying size as the free piston assembly moves along the prescribed path, a Rankine cycle power loop driving the expansion-compression device, and a vapor compression heat pump loop driven by the expansion-compression device comprising the steps of:

a. selectively introducing the power loop working fluid into the first subchamber at a first pressure to move the free piston assembly toward the second subchamber linearly and induce kinetic energy in the free piston assembly; and, b. selectively introducing the heat pump loop working fluid into the second subchamber at a second pressure prior to introduction of the power loop working fluid into the first subchamber so that the moving free piston assembly compresses the heat pump loop working fluid in the second subchamber, step a) further including adjusting the time period of introduction of the power loop working fluid into the first subchamber so that kinetic energy induced in the moving free piston assembly by the power loop working fluid is transferred to the heat pump loop working fluid in the second subchamber as work of compression.

2. A method of operating a dual loop heat pump system with an expansion-compression device, a Rankine cycle power loop driving the expansion-compression device, and a vapor compression heat pump loop driven by the expansion-compression device, the expansion-compression device having a linearly movable operating free piston assembly including a first piston slidably carried in a first chamber for linear movement in the chamber along a prescribed path and a second piston slidably carried in a second chamber for linear movement in the second chamber along the prescribed path, the first piston dividing the first chamber into a first subchamber of varying size as the free piston moves along the prescribed path and a second subchamber of varying size as the free piston moves along the prescribed path, and the second piston dividing the second chamber into a third subchamber of varying size as the free piston moves along the prescribed path and a fourth subchamber of varying size as the free piston moves along the prescribed path, the free piston assembly further including a piston rod fixably connecting the first piston to the second piston so that said second subchamber and said fourth subchamber are simultaneously of minimum size and said first subchamber and said third subchamber are simultaneously of minimum size; the method comprising the steps of:

a. alternatively introducing the power loop working fluid into the second subchamber at a first pressure to move the free piston assembly toward said first and third subchambers and induce kinetic energy in said free piston assembly, and into said third subchamber at said first pressure to move the moving free piston assembly toward the second and fourth subchambers and induce kinetic energy in the free piston assembly; and, b. alternatively introducing the heat pump loop working fluid into the fourth subchamber at a second pressure lower than said first pressure as the free piston assembly moves toward the first and third subchambers and introducing the heat pump loop working fluid into the first subchamber at the second pressure lower than the first pressure while the free piston assembly is moving toward the second and fourth subchambers so that the moving free piston assembly alternately compresses the heat pump loop working fluid in the first subchamber as the free piston assembly moves toward the first and third subchambers and compresses the heat pump loop working fluid in the fourth subchamber as the free piston assembly moves toward the second and fourth subchambers, step a) further including adjusting the time period of introduction of the power loop working fluid alternatively into the second subchamber and the third subchamber so that kinetic energy induced in the moving free piston assembly by the power loop working fluid is transferred to the heat pump loop working fluid in the first and fourth subchambers as work of compression.

3. The method of claim 2 wherein step a) includes detecting the velocity of the free piston assembly along a prescribed portion of its linear movement and adjusting the time of introduction of the power loop working fluid alternatively into the second subchamber and the third subchamber so that the free piston assembly has a substantially zero velocity when the first and third subchambers are of minimum size and when the second and fourth subchambers are of minimum size.

4. The method of claim 2 wherein substantially all of the linear kinetic energy of the free piston assembly as the free piston assembly moves toward the first and third subchambers is transferred to the working fluid in the first and third subchambers as work of compression; and, wherein substantially all of the linear kinetic energy of the free piston assembly as the free piston assembly moves toward the second and fourth subchambers is transferred to the working fluid in the second and fourth subchambers as work of compression.

5. The method of claim 1 wherein substantially all of the linear kinetic energy of the free piston assembly as the free piston assembly moves toward the second subchamber is transferred to the working fluid in the second subchamber as work of compression.

6. The method of claim 5 wherein step a) further includes sensing the velocity of the free piston assembly as the free piston assembly moves toward the second subchamber and adjusting the time period of introduction of the power loop working fluid into the first subchamber so that the free piston assembly reaches a substantially zero velocity at a prescribed position while moving toward the second subchamber in order that substantially all of the kinetic energy induced into the moving free piston assembly by the power loop working fluid is transferred to the heat pump loop working fluid in the second subchamber as work of compression.

7. The method of claim 5 further including the step of:

c. moving the free piston assembly back toward the first subchamber after the free piston assembly is moved toward the second subchamber.

8. The method of claim 7 wherein step b) is performed simultaneously with step (c).

9. The method of claim 8 wherein step c) includes selectively associating the working fluid of the power loop with the free piston assembly of the expansion-compression device to cause the power loop working fluid to drive the free piston assembly lineraly toward the first subchamber.

10. The method of claim 7 wherein the vapor compression heat pump loop includes a condenser and an evaporator and wherein step b) includes connecting the condenser in the heat pump loop to the second subchamber as the free piston assembly moves toward the second subchamber to cause the heat pump working fluid in the second subchamber being compressed by the movement of the free piston assembly as it moves toward the second subchamber to be discharged into the condenser and connecting the evaporator in the heat pump loop to the second subchamber while the free piston assembly is moving back toward the first subchamber to cause the heat pump loop working fluid in the evaporator to be drawn into the second subchamber as the free piston assembly is moved toward the second subchamber.

11. A heat pump system comprising:

an expansion-compression device defining a chamber therein and including a linearly movable free piston assembly slidably carried in said chamber for linear movement along said chamber, said free piston assembly dividing said chamber into a first subchamber of varying size as said free piston assembly moves along said chamber and a second subchamber of varying size as said free piston assembly moves along said chamber;

a Rankine cycle power loop having a working fluid;

a vapor compression heat pump loop having a working fluid; and, control means for selectively introducing the power loop working fluid into said first subchamber at a first pressure to move said free piston assembly toward said second subchamber linearly and induce linear kinetic energy in said free piston assembly, for selectively introducing the heat pump loop working fluid into said second subchamber at a second pressure prior to introduction of the power loop working fluid into said first subchamber so that said moving free piston assembly compresses the heat pump loop working fluid in said second subchamber, and for selectively adjusting the time period of introduction of the power loop working fluid into said first subchamber so that substantially all of the kinetic energy induced in said moving free piston assembly by the power loop working fluid is transferred to the heat pump loop working fluid in the second subchamber as work of compression.

12. The heat pump system of claim 11 wherein said power loop includes boiler means for introducing heat into said power loop working fluid having an inlet and an outlet, said boiler outlet operatively connected to said expansion-compression device through said control means; power loop condenser means having an inlet and an outlet, said condenser inlet operatively connected to said expansion-compression device; liquid pump means having an inlet and an outlet, said liquid pump inlet operatively connected to said outlet of said power loop condenser means and said liquid pump outlet operatively connected to said inlet of said boiler means; and wherein said heat pump loop includes heat pump condenser means having an inlet and an outlet, said heat pump loop condenser inlet operatively connected to said expansion-compression device through said control means; expansion valve means having an inlet and an outlet, said expansion valve inlet operatively connected to said outlet of said heat pump loop condenser means; and evaporator means having an inlet and an outlet, said evaporator inlet operatively connected to said outlet of said expansion valve means and said evaporator outlet operatively connected to said expansion-compression device through said control means.

13. The heat pump system of claim 12 wherein said power loop condenser means and said heat pump loop condenser means are combined and wherein said power loop working fluid and said heat pump loop working fluid is the same working fluid.

14. In a heat pump system having an expansion compression device driven by a Rankine cycle power loop with a working fluid and driving a vapor compression heat pump loop with a working fluid where the expansion-compression device includes a housing defining a pair of working chambers therein coaxially arranged about a common central axis, a free piston assembly slidably carried by the housing for linear reciprocal movement along the central axis, the free piston assembly including a first piston dividing one of the chambers into subchambers, a second piston dividing the other chamber into subchambers, and a piston rod fixedly connecting the pistons so that they move together, the improvement comprising:

first valve means for selectively introducing power loop working fluid at a first pressure into a first of said subchambers to move said free piston assembly in a first direction along the central axis and induce kinetic energy therein while stimultaneously enlarging the volume of said first subchamber and a second of said subchambers, and while stimultaneously reducing the volume of a third and a fourth of said subchambers; and for alternatively selectively introducing power loop working fluid at said first pressure in said third subchamber to move said free piston assembly in a second direction along the central axis opposite said first direction while stimultaneously enlarging the volume of said third and fourth subchambers and while stimultaneously reducing the volume of said first and second subchambers.

second valve means for selectively introducing heat pump loop working fluid at evaporator pressure into said second subchamber while said free piston assembly is moving in said first direction and for selectively introducing heat pump loop working fluid at evaporator pressure into said fourth subchamber while said free piston assembly is moving in said second direction, said second valve means further selectively maintaining the heat pump loop working fluid within said fourth subchamber while said free piston assembly moves in said first direction to cause said moving free piston assembly to compress the heat pump loop working fluid in said fourth subchamber to condenser pressure and selectively maintaining the heat pump loop working fluid within said second subchamber while said free piston assembly moves in said second direction to cause said moving free piston assembly to compress the heat pump loop working fluid in said second subchamber to condenser pressure;

sensing means for detecting the velocity of said free piston assembly at a first position while said free piston assembly is moving in said first direction and for detecting the velocity of said free piston assembly at a second position while said free piston assembly is moving in said second direction; and, control means operatively associated with said sensing means and said first valve means to adjust the period of time said power loop working fluid is introduced into said first subchamber and said second subchamber in response to said sensing means so that said free piston assembly has a substantially zero velocity at a prescribed position while moving in said first direction and at another prescribed position while moving in said second direction so that the kinetic energy of said free piston assembly induced therein by said power loop working fluid is used as work of compression for said working fluid.

15. A heat pump system comprising:

evaporator means having an inlet and an outlet;

condenser means having an inlet and an outlet;

boiler means having an inlet and an outlet;

expansion valve means having an inlet and an outlet;

liquid pump means having an inlet and an outlet;

expansion-compressor means defining a first chamber and a second chamber therein, said compressor means including a linearly movable free piston assembly, said free piston assembly comprising:

a first piston movably carried in said first chamber and dividing said first chamber into a first compression subchamber and a second driving subchamber;

a second movably carried in said second chamber dividing said second chamber into a third compression subchamber and a fourth driving subchamber; and, a piston rod extending between said chambers and fixedly connecting said first piston and said second piston for movement in unison in a first stroke along a prescribed path and a second stroke opposite said first stroke along said prescribed path;

inlet check valve means operatively connecting said first and second compression subchambers to said outlet of said evaporator means;

outlet check valve means operatively connecting said first and second compression subchambers to said inlet of a condenser;

first inlet valve means operatively connecting said second driving subchambers to said outlet of said boiler means;

second inlet valve means operatively connecting said fourth driving subchambers to said outlet of said boiler means;

first outlet valve means operatively connecting said second driving subchamber to said inlet of said condenser means;

second outlet valve means operatively connecting said fourth driving subchamber to said inlet of said condenser means;

a working fluid in said system; and, control means for controlling said first and second inlet valves and said first and second outlet valves, said control means responsive to the velocity of said piston assembly as said piston assembly approaches the end of each of said strokes to adjust the time period said first and second inlet valves remain open to allow said working fluid from the outlet of said boiler means to alternatively enter said second and fourth driving subchambers and induce linear kinetic energy in said free piston assembly so that substantially all of the kinetic energy of the free piston assembly is transferred to said working fluid in said first and second working subchambers as work of compression.

16. The heat pump system of claim 12 wherein said control means includes boiler valve means selectively connecting said boiler outlet to said first subchamber and sensing means for detecting the velocity of said free piston assembly at a first position while said free piston assembly is moving toward said second subchamber, said boiler valve means operatively associated with said sensing means to cause said boiler valve means to adjust the period of time the power loop working fluid from said boiler is introduced into said first subchamber in response to said sensing means so that said free piston assembly has a substantially zero velocity at a prescribed position while moving toward said second subchamber and transfer the kinetic energy induced in said moving free piston assembly by the power loop working fluid to the heat pump loop working fluid in said second subchamber as work of compression.

17. The heat pump system of claim 12 further including means for moving said free piston assembly toward said first subchamber.

18. The heat pump system of claim 12 wherein said control means includes first check valve means operatively connecting said second subchamber to the inlet of said heat pump loop condenser means so that the heat pump loop working fluid in said second subchamber is discharged into said heat pump loop condenser means through said first check valve means as said free piston assembly moves toward said second subchamber, and second check valve means connecting the outlet of said evaporator means to said second subchamber so that the heat pump loop working fluid is drawn into said second subchamber from said evaporator means as said free piston assembly is moved toward said first subchamber.

* * * * *